United States Patent [19]

Gilli et al.

[11] 4,164,848

[45] Aug. 21, 1979

[54] METHOD AND APPARATUS FOR PEAK-LOAD COVERAGE AND STOP-GAP RESERVE IN STEAM POWER PLANTS

[75] Inventors: Paul V. Gilli, Obere Teichstrasse 21/i, 8010 Graz; Georg Beckmann, Vienna, both of Austria

[73] Assignee: Paul Viktor Gilli, Graz, Austria

[21] Appl. No.: 752,861

[22] Filed: Dec. 21, 1976

[51] Int. Cl.[2] ..... F01K 3/00

[52] U.S. Cl. ..... 60/652; 60/653; 60/677; 122/35; 60/659

[58] Field of Search ..... 60/652, 659, 676, 677, 60/653; 122/35

[56] References Cited

U.S. PATENT DOCUMENTS

| | | | |
|---|---|---|---|
| 3,818,698 | 6/1974 | Beckmann et al. | 122/35 X |
| 3,982,379 | 9/1976 | Gilli et al. | 60/652 X |

FOREIGN PATENT DOCUMENTS

| | | | |
|---|---|---|---|
| 1285498 | 7/1928 | United Kingdom | 60/659 |

*Primary Examiner*—Allen M. Ostrager

*Assistant Examiner*—Stephen F. Husar

*Attorney, Agent, or Firm*—Max Fogiel

[57] ABSTRACT

An arrangement for storing energy to cover peak-load conditions and serve as a stop-gap reserve in steam power plants. A live steam generator is connected to a steam turbine, and a storage vessel is provided with a steam cushion volume and a water content volume. The water content of the storage vessel is connected, on the one hand, to a single-or multi-stage secondary steam generator which is connected, in turn, on the steam side to the turbine by a working steam line. A hot-water return line connects the secondary steam generator on the water side to the feed water line and/or a compensation vessel connected to the feed water line. The steam cushion volume of the storage vessel is connected, on the other hand, by a steam line, to a point of the main steam cycle of the plant which is upstream of the entry point of the working steam line. In particular, the steam cushion is connected to the live steam line. The secondary steam generator may be in the form of one or several flash tanks or heat exchangers. It also may consist of several superheaters through which hot water flows.

29 Claims, 9 Drawing Figures

METHOD AND APPARATUS FOR PEAK-LOAD COVERAGE AND STOP-GAP RESERVE IN STEAM POWER PLANTS

BACKGROUND OF THE INVENTION

The present invention relates to means and procedures of energy storage in steam power plants for the purpose, on the one hand, of peak-load coverage by means of storage vessels with steam cushion and water content and, on the other hand, for stop-gap reserve. It makes possible continued operation of the steam turbine in case of failure of the steam generator.

There are already known in the art hot-water storage vessels which are connected parallel to the feed water preheater network and, in case of need during peak load or overload, supply the steam generator with preheated feed water. Their effect is based on the concept that the last or all stages of bleeding from the turbine are closed, so that there results in the low-pressure section of the turbine a higher mass flow than in the normal case and hence a higher than normal output.

This known layout has limited output, the maximum overload being achieved by completely closing the bleeds. Another disadvantage are losses resulting from the dependence of the bleeding pressures and hence of the feed water temperature on the load during charging and discharging. These losses result in a reduction of the storage efficiency. Furthermore, the layout pressure of the storage vessel is tied to the feed water temperature; this means, the layout pressure of the storage vessel cannot substantially exceed the saturation pressure corresponding to the feed water temperature. With previous steam power plants, feed water temperature and economically optimum storage pressure were adapted to each other. Recent developments resulted, on the one hand, in a reduction of the feed water temperature (as, e.g., with the light water reactors, the heavy water reactors or gas-cooled reactors); on the other hand, the development of prestressed storage vessels made it possible and economically meaningful to use high and highest storage pressure, so that the optimum storage pressure is much higher than the saturation pressure associated with the feed water temperature.

Another disadvantage of previous feed water storage is that in the absence of steam delivery, continued operation of the steam turbine is not possible. This disadvantage particularly affects nuclear power plants where, due to the generally high block power output, in view of the power grid, there must be an immediate stop-gap reserve (available within seconds or fractional seconds) for the reactor and steam generator; this also applied to solar-heat power plants where, in view of brief sudden interruptions of solar irradiation, e.g., by passing clouds, there must be a short-term stop-gap reserve and a longer-term stop-gap reserve to compensate for the solar radiation absent during the night.

The previously published constructions intended for stop-gap reserve have great disadvantages. Storage vessels designed as variable pressure storage vessels in case of steam withdrawal lose pressure quite rapidly and as a result the throughput capacity of the turbine and the capacity for doing work decrease rapidly; hence they cannot (or only at the price of a large power drop) be connected to the live steam line. Constant-pressure heat storage vessels (storage with water circulation) have the great disadvantage that steam delivery requires a certain time required for starting the circulating pump and for delivering the hot water to the flash tank or heat exchanger so that this type of storage also appears to meet the present-day high requirements for immediately available stop-gap reserve. With the so-called expansion storage vessel which, as the constant-pressure heat storage vessel, has a fairly constant pressure and where water is not circulated but is extracted from the storage vessel, flashed and then delivered to a low-temperature vessel, the time until steam delivery is too long for stop-gap reserve purposes.

Accordingly, it is an object of the present invention to provide an arrangement which avoids the disadvantages of storage vessels known in the art, while retaining their advantages.

Another object of the present invention is to provide an arrangement of the foregoing character which may be economically constructed and maintained in service.

A further object of the present invention is to provide an arrangement, as described, which has a substantially long operating life.

SUMMARY OF THE INVENTION

The present invention avoids the disadvantages of the known storage vessels, while retaining their advantages, by providing on the one hand, that the water volume of the storage vessel is connected to a single- or multi-stage secondary steam generator which is connected on the steam side via a working steam line to the turbine and on the water side via a hot-water return line to the feed water line and/or a compensation vessel connected to this feed water line. On the other hand, the steam cushion of the storage vessel is connected via a steam line to a point of the main steam cycle of the plant which is upstream of the entry point of the working steam line, in particular to the live steam line.

Other improvements of the present invention are as follows: The secondary steam generator comprises one or several flash tanks or one or several heat exchangers and the steam generators comprise one or several superheaters through which hot water flows. Further, the steam generator preferably comprises heat exchangers whose primary side is connected to the water volume via hot-water lines while the secondary side is connected, on the one hand, via feed lines, water separated from the main steam cycle, particularly from the moisture separators and/or the reheater to the heat exchanger, and, on the other hand, is connected to the main steam cycle via evaporation lines.

For mere peak-load coverage, the hot-water return line between the highest preheater stage and the live steam generator can discharge into the feed water line. For the purpose of continued energy supply, in case of failure of the live steam gemerator, the hot water return line can be connected to a compensation vessel which itself is connected to the feed water line (not only the full load corresponding to the steam generator output can be achieved, but also peak load). In this case, in accordance with the present invention, immediately after the failure of the steam supply from the steam generator, the steam quantity necessary for maintenance of the full or nearly full turbine output is taken from the storage, preferably at live steam pressure, so that there is no interruption of the steam delivery and the power delivered by the turbine. Hence, the storage at the beginning of the discharge acts as variable-pressure storage. Recirculation internals are provided, but only in the uppermost portion of the water volume and possibly in the steam cushion, so as to achieve a quickly starting short-circuit cycle in the uppermost portion of the water volume and hence a quick start of steam formation. To maintain its pressure as far as possible, immediate after the failure and after the start of the steam withdrawal from the steam cushion, depending on the requirements of the grid on the power to be delivered by the turbine, change-over is made in a controlled manner to water withdrawal (expansion storage operation); the pressure and the temperature in the storage remain nearly constant. There may result a certain power loss in comparison with live steam operation from the steam cushion. This loss, however, can be kept relatively low, for example by introducing the steam from the first flash tank ahead of the reheater and superheating by condensing steam from the steam cushion of the storage vessel. It must be noted that with storage operation all bleeders (taps) of the turbine are not in operation, since the feeder pump of the steam generator and the condensate pump are turned off.

Further improvements of the present invention are as follows: The pipe line from the steam volume of the storage vessel discharges into the live steam line (making possible high output in case of failure of steam delivery from the steam generator) and this pipe line is connected to a steam-heated reheater, as used with nuclear power plants; furthermore, only one storage vessel of very large power (output) or very few storage vessels of prestressed construction are provided (making high pressures and high outputs economically possible) and the storage vessels have phase-separation internals in the steam cushion and spray nozzles for charging.

Additional improvements of the present invention are: the feed water tank has a volume of more than half that of the storage vessel; the working steam line discharges into the main steam cycle before or after the reheater and the steam line branches off from the main steam cycle ahead of the reheater.

The procedures in accordance with the present invention are as follows: For operating the system at peak load or at overload, a flash steam valve is opened, the storage water pump is started and the delivery of the feed water pump is reduced; at full peak load, the delivery is reduced to zero or the pump is shut off altogether.

To charge the storage vessel during operation of the main steam cycle, the delivery of the feed water pump is increased, the water valve in the hot water charge line is opened and the steam valve also is opened.

For regulating the peak load or overload, the opening of the flash steam valve is regulated depending on the required power, in such a way that the opening is increased to increase the power.

During operation of the plant, the delivery of the storage water pump is regulated depending on the amount of water flowing through the hot-water line and/or depending on the water level in the flash tank, in such a way that the delivery is increased as the amount of water and/or the water level is increased.

Through the means and procedures of the present invention, much higher peak load or overload factors are achieved than with previously known arrangements, without requiring a separate peak-load turbine. Furthermore, the technically and economically feasible high storage pressures can be efficiently utilized so that high specific storage outputs and high storage efficiencies can be attained.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
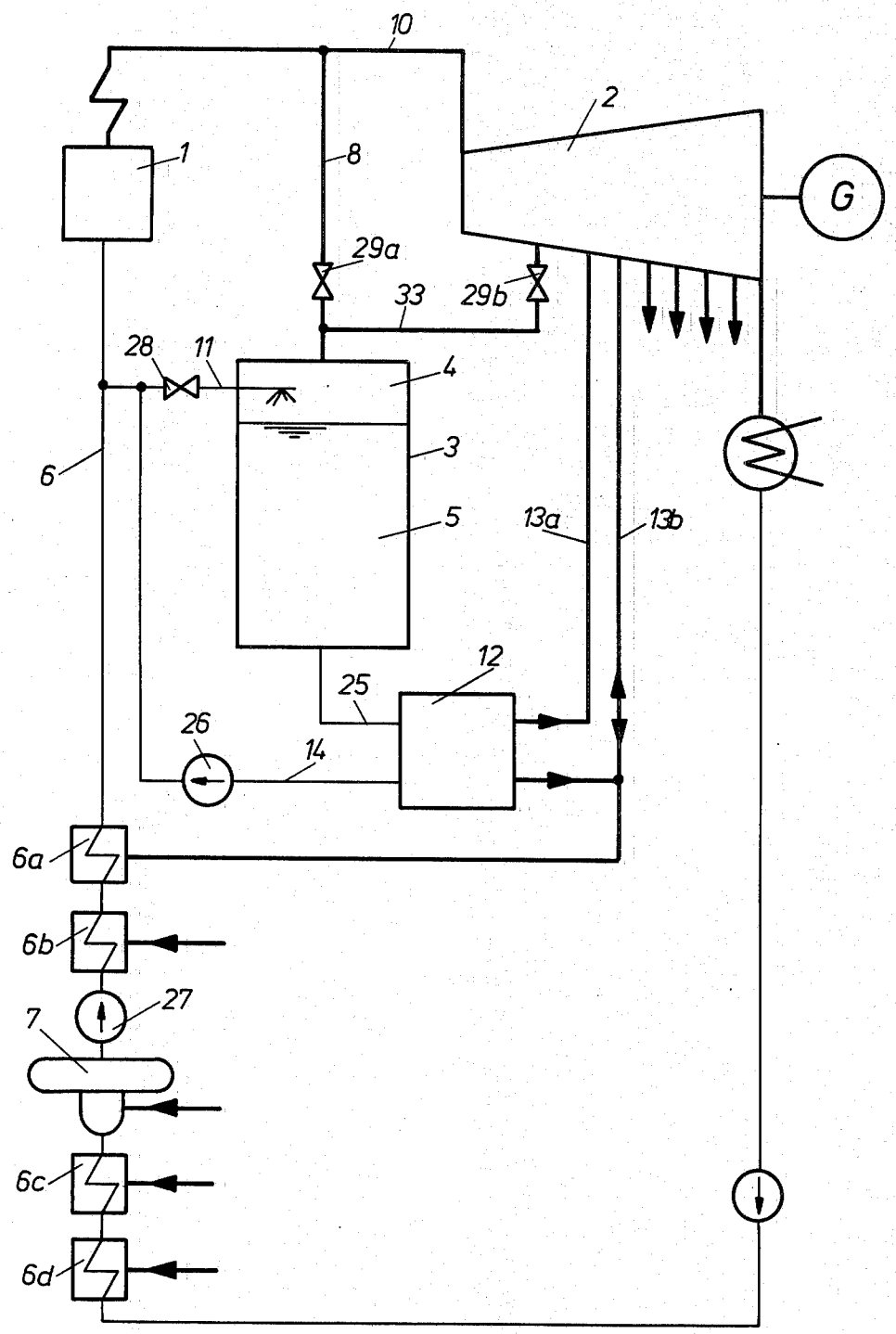
FIG. 1 is a schematic diagram and shows the arrangement in accordance with the present invention.

In FIG. 1, reference numeral 1 is the steam generator, 2 the steam turbine, 3 the storage vessel with steam cushion 4 and water volume 5. The feed water preheater network is denoted by (6*a, b, c, d*) and the feed water tank is noted by 7. The feed water tank is equipped to receive the excess cold water; alternatively, a separate compensation vessel may be provided.

The storage tank is charged, on the one hand, with preheated feed water via the hot water charge line 11 with water valve 28 and, on the other hand, with steam of suitable pressure and suitable temperature via the steam line 8 and the steam valves (29*a, b*). For example, FIG. 1 provides for charging with live steam from the live steam line 10. Depending on the state of the live steam, bleeder steam of suitable temperature may be used or a return pass (29*a, b*) may be provided.

During the discharge from the storage vessel 3, hot water is withdrawn from it via a hot water line 25, delivered to a single- or multi-stage steam generator 12 which supplies the steam turbine 2 with steam via the working steam lines (13*a, b*). The partially cooled hot water is then fed via a hot water return line 14 and a storage water pump 26 between the feed water preheater (6*a*) and steam generator 1 into the feed line. At the same time, the output of the feed water pump 27 is reduced accordingly.

Figure 2:
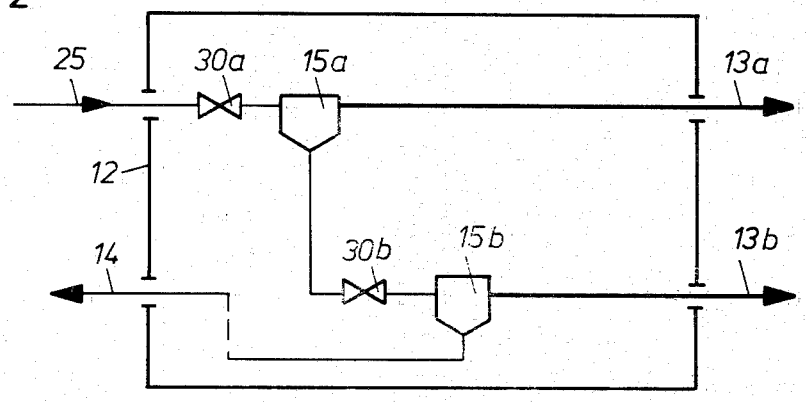
FIGS. 2, 3 and 4 show embodiments of the secondary steam generator.

FIG. 2 shows an embodiment of the secondary steam generator 12, as two-stage flash steam generator with the flash tanks (15*a, b*) and the associated flash steam valves (30*a, b*) by means of which, the water level in the following flash steam generators is regulated. The quantity regulation and hence output regulation is accomplished by means of the storage water pump 26.

Figure 3:
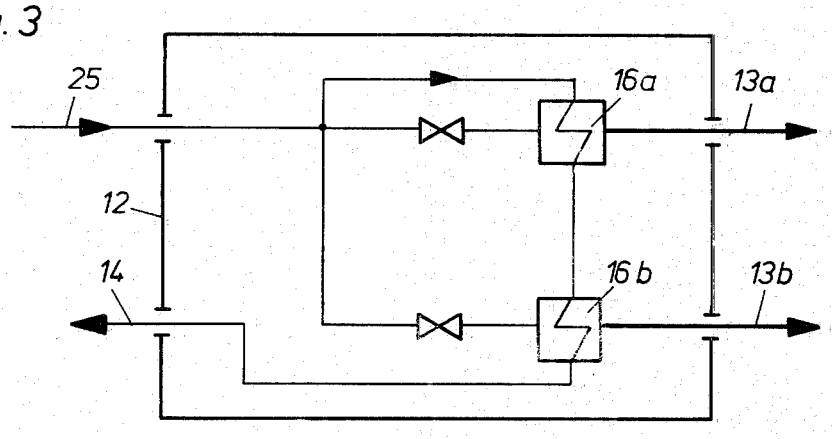

FIG. 3 shows an alternative in the construction of the secondary steam generator 12 of FIG. 2 where part of the hot water from the hot water line 25 passes over heat exchangers (16*a, b*) acting as evaporator, while another portion is supplied as feed water to the secondary side of the heat exchangers (16*a, b*); this feed water is evaporated in the heat exchanger and, if necessary, is slightly superheated.

Figure 4:
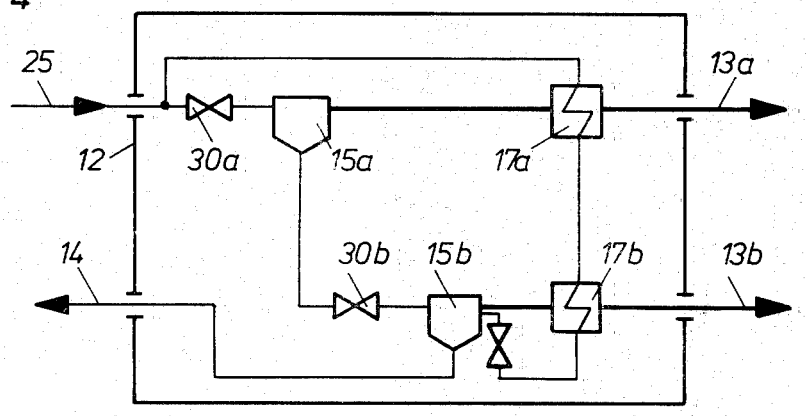

FIG. 4 shows another alternative with flash tank steam generators (15*a, b*) and connected superheaters (17*a, b*). The superheaters (17*a, b*) are heated with hot water from the hot water line 25.

Figure 5:
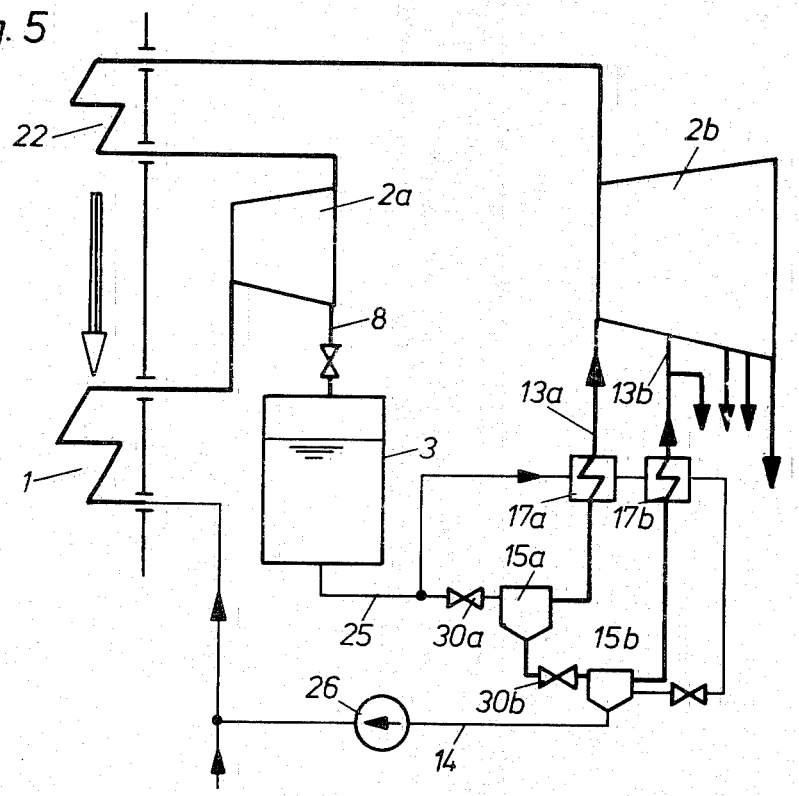
FIG. 5 shows an embodiment particularly suited to nuclear power plants with gas-cooled reactors.

FIG. 5 shows an embodiment for a nuclear power plant with gas-cooled high-temperature reactor. It is characteristic of this reactor that pressure and temperature of the live steam as well as the reheater temperature are high, while the feed water temperature is relatively low. Also, the pressure drop in the reheater is relatively high. Hence, the storage vessel 3 is fed with cold intermediate steam ahead of the reheater, while the discharge is made into the hot intermediate steam. Preferably, because of the low feed water temperature, a second flash tank (15*b*) is provided.

Figure 6:
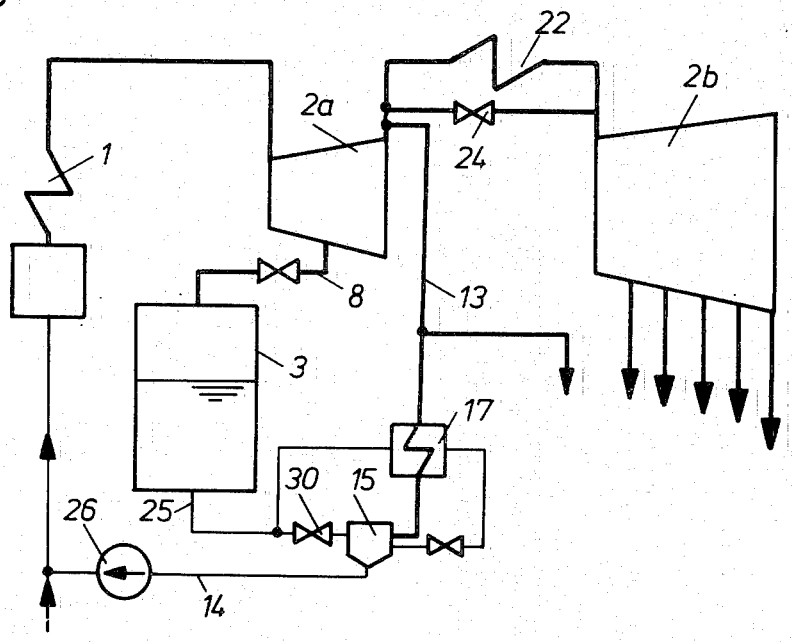
FIG. 6 shows an embodiment particularly advantageous for steam power plants with fossile-fuel steam generators.

FIG. 6 shows an embodiment of the present invention for power plants with high live-steam pressures and high live-steam and intermediate steam temperatures. The hot water coming from the storage vessel 3, after passing through a flash tank 15 with superheater 17 is fed via the working steam line 13 ahead of the reheater 22. To influence the absorption capacity of the low pressure flow of the steam turbine 2, a regulatable portion of the supplied steam is directed to a reheater-bypass valve 24. This construction is preferably used for fossile-fuel steam generators, solar-heated steam power plants, liquid-metal cooled reactors, fusion reactors and other steam generators with high pressures and high superheating temperatures.

Figure 7:
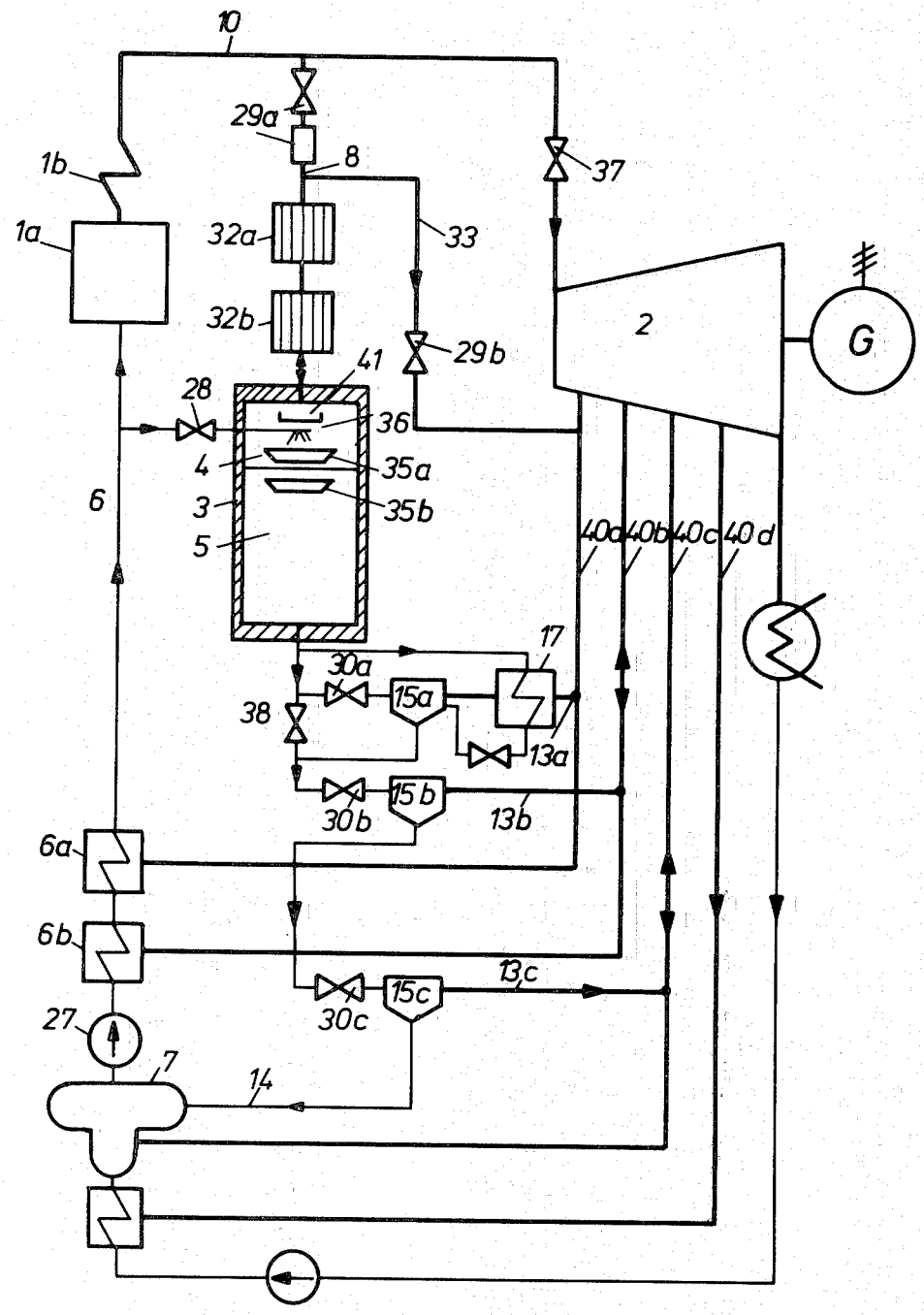
FIG. 7 shows the application of the concept of the present invention for failure reserve and for peak load coverage for a steam power plant with superheater, but without reheater, with the hot-water return line leading to the deaerator of the feed water tank.

FIG. 7 shows an embodiment for a steam power plant with superheater (1*b*), but without reheater, for peak load coverage and failure reserve. The steam generator may be heated, for example, with oil or coal or by solar energy. The steam turbine 2 is fed via the live steam line 10 and via the turbine valve 37. Its evaporating steam is precipitated in a condenser 39. The storage vessel 3 with a steam cushion 4 and a water volume 5 is connected via the steam line 8 with the live steam line 10. In this steam line 8 there is a steam valve (29*a*) and preferably a superheater/desuperheater storage vessel 32 which may comprise several series connection sections (32*a, b*). The superheater/desuperheater storage vessel may be a hot-water storage vessel of high pressure or a solid-state storage or a storage vessel with a high-boiling point liquid (for example glycerine, thermo oil or alkali metal).

During discharge, water is taken from the water volume 5 of storage vessel 3 and delivered via the flash steam valves (30*a, b, c*) to the flash tanks (15*a, b, c*) in which, through pressure lowering, steam is generated which is delivered via the working steam lines (13*a, b, c*), using sections of the bleeder lines (40*a, b, c*) to the appropriate pressure stages of the steam turbine (2). Preferably, the steam from the first flash tanks (40*a*) is superheated by means of a superheater 17 charged with storage water. In an analog fashion, the steam from the remaining flash tanks may be superheated. The regulation of the steam delivery is accomplished by means of the hot-water by-pass valve 38.

In order to achieve immediate start of the water circulation in the storage vessel at the beginning of the discharge, in case of sudden failure of the steam supply, the upper portion of the water volume has recirculation internals (35*a, b*) and the steam cushion has phase-separation internals 41. In addition, the steam cushion has spray nozzles 36 which branch off via a line with water valve 28 between the last feed water preheater (6*a*) and the steam generator 1 from the feed water line 6.

The cooled water freed during the discharge of the storage vessel as expansion storage, is collected in a storage vessel which in this case is combined with the feed water tank 7.

The discharge of the storage vessel proceeds first from the steam cushion via the steam line 8, the superheater/desuperheater storage vessel 32 and the steam valve (29*a*) which is a quick-opening valve and may contain a return valve. Depending on pressure conditions, discharge may also take place, instead of into the live steam line, via the connection line 33 and the steam valve (29*b*) into a stage of the turbine with lower pressure.

The layout of FIG. 8, which is particularly useful for nuclear power plants of modern design, differs from the layout of FIG. 7 as follows: A moisture separator 21 and a steam-heated reheater 22 is present. The reheater, during discharge of the storage, is heated via the steam line 8 and the reheater heating line 9 with saturated steam of suitable pressure. The water separated in the moisture separator 21 and the condensate from the steam-heated reheater 22 are preferably delivered via a feed line 20 to the flash tank 15 of suitable pressure.

The steam from the first flash tank (15*a*) is superheated with the reheater 22, and the steam from the second flash tank (15*b*) is superheated by means of a superheater 17 heated with storage water.

Differing from FIG. 7, the compensation vessel 31 is separate from the feed water tank. The steam valve (29*a*) including return valve and steam valve (29*b*) of FIG. 7 is replaced in this case, where live steam pressure and storage pressure are equal or nearly equal, by a common steam valve 29.

Figure 8:
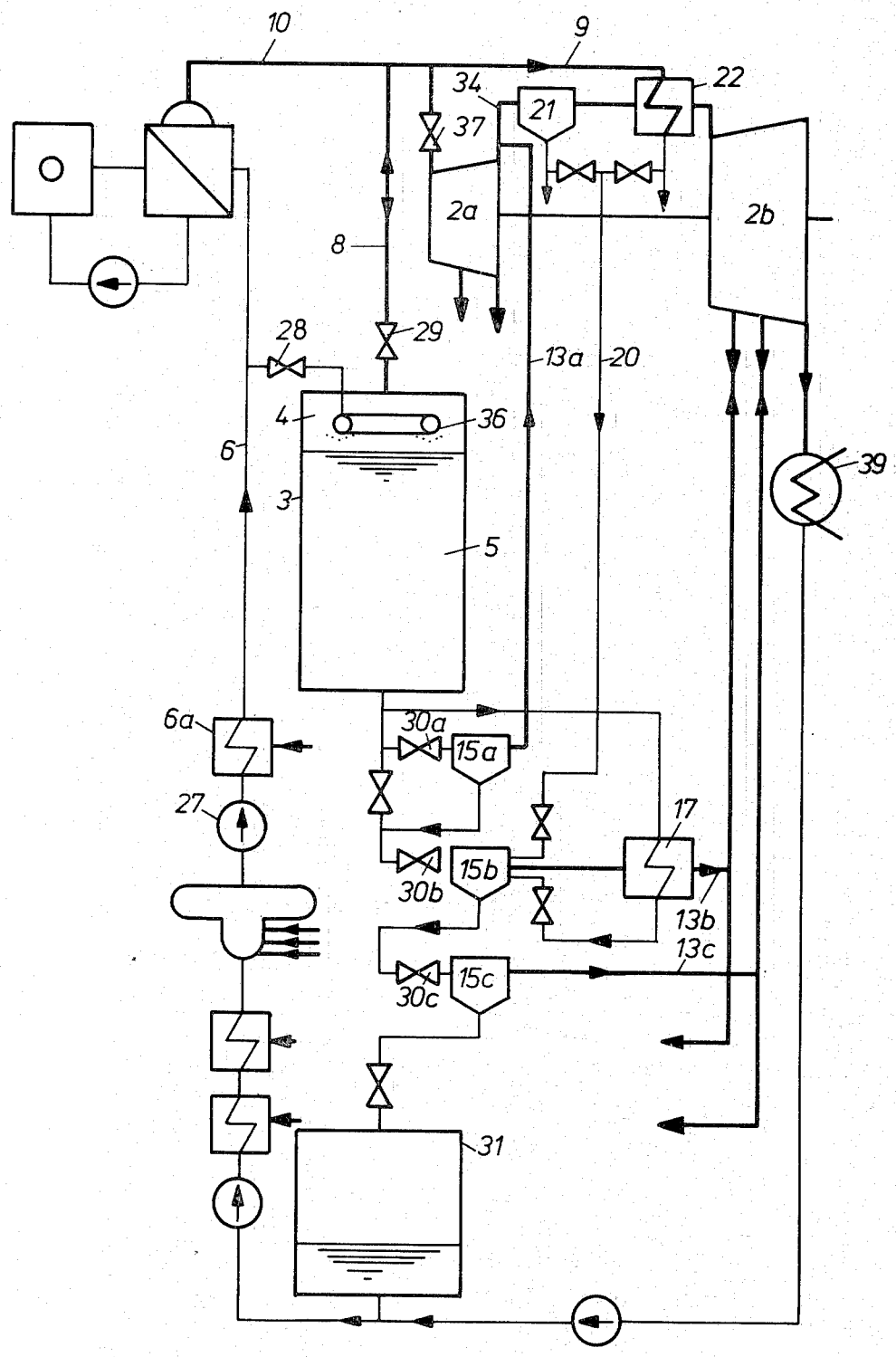
FIG. 8 shows a steam power plant without superheater, but with reheater, an arrangement generally used with present-day nuclear power plants.

The present invention includes not only the means described and shown as an example in FIGS. 7 and 8, but also the procedures for their operation. For example, the procedure in accordance with the present invention for the arrangement of FIG. 7 is as follows: In case of failure of the steam supply from the steam generator 1, the steam valve (29*b*) and the flash steam valves (30*a, b, c*) are opened simultaneously and quickly, and then the steam valve (29*b*) is closed again as needed.

Another procedure for operating the plant for continuous energy generation in case of failure of the steam supply from the steam generator 1 is as follows: During normal operation, the turbine valve 37 and the steam valve 29 are opened, while the water valve 28 and the flash steam valves (30*a, b, c*) and the hot-water bypass valve 38 are closed; immediately after the failure of the steam generator 1, the flash steam valves (30*a, b, c*) are opened and after achieving steam delivery from the flash tanks (15*a, b, c*), the turbine valve 37 is closed entirely or up to a low flow of cool (sic.) steam.

Further procedural improvements are as follows: To increase the turbine output, the opening of the flash steam valves with the higher pressure (30*a*) is increased in relation to the flash steam valve of low pressure (30*c*) so that the pressure level in the steam line and hence the handling capacity of the turbine is increased.

In order to keep the steam flows in the working steam lines (13*a, b, c*) constant, even with slightly decreasing pressure in the storage vessel, the hot-water bypass valve 38 is first opened a little and closed again towards the end of the discharge.

Another procedural improvement is as follows: For a brief output increase, the turbine valve 37 is opened or its opening increased so that steam of nearly live condition flows into the turbine.

A final procedural improvement is as follows: For charging the storage vessel 3, the steam valve 29 is opened up to pressure compensation and then the water valve 28 is opened, with the steam valve 29 being regulated depending on available excess output and the water valve 28 being regulated depending on the amount of steam flowing through the steam line 8.

Figure 9:
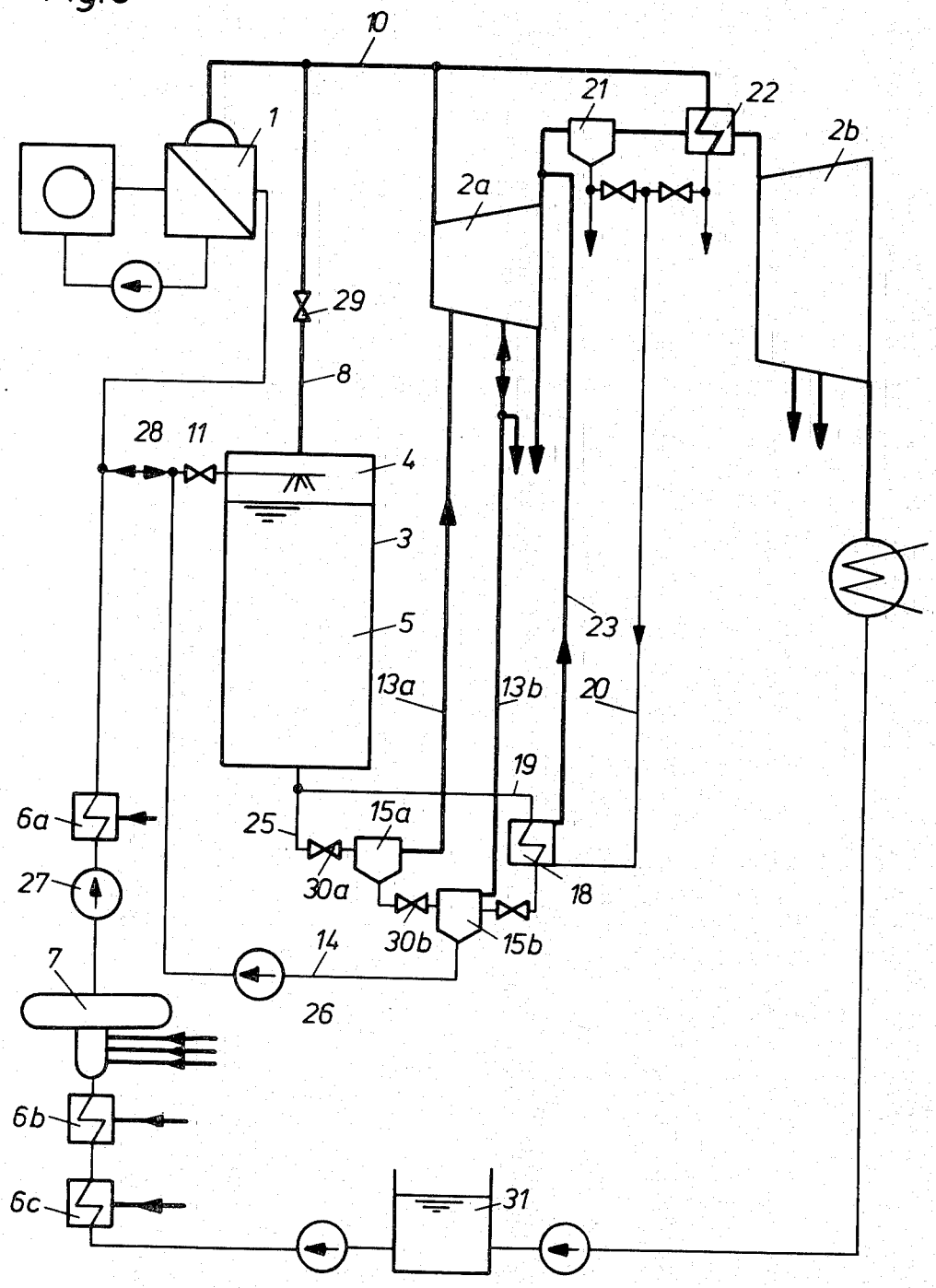
FIG. 9 also shows a diagram for a nuclear power plant for the purpose of pure peak load coverage.

In FIG. 9, a nuclear reactor, particularly a pressurized water reactor, provides the steam generator. A reheater 22, heated with live steam, and a moisture separator 21 ahead of it are provided. In case of overload, both the flash tanks (15*a, b*) and the corresponding flash steam valves (30*a, b*) are supplied via the hot water line 25, and the heat exchanger 18 is supplied via the branch line 19 branching off from the hot water line, with hot water from the storage vessel. The hot water from reheater 22 and moisture separator 21, which was delivered to the evaporator 18 via the feed line 20 is evaporated there, and then delivered via the evaporation line 23 to the main steam cycle ahead of the moisture separator 21 and the reheater 22. This is made possible by the initially mentioned high storage pressure which is above the pressure of the steam flowing through the reheater. The resupply of the steam in the evaporation line 23, relative to the water in the feed line 20 is accomplished by the difference in density. Reference numeral 31 denotes a compensation vessel.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention, and therefore, such adaptations should and are intended to be comprehended within the meaning and range of equivalence of the following claims.

What is claimed is:

1. An arrangement for energy storage for peak load coverage and reserve in a steam power plant, comprising: live steam generator means; a steam turbine connected to said live steam generator means by a live steam line; a storage vessel with steam cushion volume and water content volume; a secondary steam generator with at least one stage; means for connecting said water content volume of said storage vessel to said secondary steam generator; a working steam line connecting said secondary steam generator on the steam side to said steam turbine; a feed water line; a cold water reservoir; a hot-water return line connecting said secondary steam generator on the water side to said feed water line and said cold water reservoir, said cold water reservoir being connected to said feed water line; a superheater; an auxiliary steam line connecting said steam cushion volume of said storage vessel to a point of the main steam cycle of the plant upstream of the entry point of said working steam line and to said live steam line following said superheater.

2. An arrangement as defined in claim 1 wherein said secondary steam generator comprises at least one flash tank.

3. An arrangement as defined in claim 2 wherein said secondary steam generator comprises a plurality of flash tanks; the flash tank having lowest operating pressure of substantially 1 bar being connected to said cold water reservoir on the water side.

4. An arrangement as defined in claim 1 wherein said secondary steam generator comprises at least one heat exchanger for heat exchange between water taken from said storage vessel and steam from said storage vessel.

5. An arrangement as defined in claim 1 wherein said second steam generator comprises at least one superheater having hot water flowing therethrough.

6. An arrangement as defined in claim 1 including a reheater connected between said working steam line and the main steam cycle, said working steam line discharging into the main steam cycle behind said reheater.

7. An arrangement as defined in claim 1 including a reheater connected between said working steam line and the main steam cycle, said working steam line discharging into said main steam cycle ahead of said reheater.

8. An arrangement as defined in claim 1 including a reheater connected between said working steam line and the main steam cycle; and means for branching said auxiliary steam line off from the main steam cycle between said live steam generator means and said reheater.

9. An arrangement as defined in claim 1 wherein said auxiliary steam line discharges into said live steam line.

10. An arrangement as defined in claim 1 including a superheater-desuperheater storage vessel in said auxiliary steam line.

11. An arrangement as defined in claim 10 wherein said superheater-desuperheater storage vessel comprises a plurality of series-connected units.

12. An arrangement as defined in claim 1 including a connection line between said auxiliary steam line and said working steam line; and a steam valve connected to said connection line.

13. An arrangement as defined in claim 1 including a plurality of preheater stages connected to said feed water line; said hot water return line discharging into said feed water line between the highest preheater stage and said live steam generator means.

14. An arrangement as defined in claim 1 including an auxiliary vessel connected to said feed water line and having more than half the volume of said first-mentioned storage vessel.

15. An arrangement as defined in claim 1 including moisture separator means connected to the main steam cycle; reheater means connected to said moisture separator means; said secondary steam generator comprising evaporator means having a first side connected to the water volume of said storage vessel; said evaporator means having a second side delivering by feed lines water separated from the main steam cycle, particularly from said moisture separator means and said reheater means to said evaporator means; said second side of said evaporator means being connected to the main steam cycle by evaporation line means.

16. An arrangement as defined in claim 1 including a reheat line; a steam-heated reheater; said steam turbine having high, medium and low-pressure stages, said steam-heated reheater being connected to said high pressure stage and being connected to the low-pressure stage by said reheat line; a reheater heating line connected to said steam-heated reheater through the auxiliary steam line.

17. An arrangement as defined in claim 1 wherein said storage vessel has a volume exceeding 1000 cubic meters and a pressure volume exceeding 30,000 bar cubic meter.

18. An arrangement as defined in claim 1 wherein said storage vessel is prestressed.

19. The arrangement as defined in claim 1 including recirculation internal means in the uppermost portion of the water volume of said storage vessel.

20. The arrangement as defined in claim 1 including spray nozzle means in said steam cushion volume of said storage vessel and fed by said feed water line of said live steam generator; and water valve means connected between said nozzle means and said feed water line.

21. A method for energy storage for peak load coverage and reserve in a steam power plant, comprising the steps of: connecting a steam turbine to a live steam generator means with a live steam line and a turbine valve therein; connecting a storage vessel with steam cushion volume and water content volume so that the water volume communicates with a secondary steam generator having at least one stage by a hot water line; connecting said secondary steam generator on the steam side to said steam turbine by a working steam line; connecting said secondary steam generator on the water side to a feed water line and a cold water reservoir by a hot-water return line, connecting said cold water reservoir to said feed water line; connecting said steam cushion volume of said storage vessel to a point of the main steam cycle of the plant upstream of the entry point of said working steam line by an auxiliary steam line with a steam valve therein; opening a flash steam valve in a line between said secondary steam generator and said storage vessel at peak load or overload; actuating a storage water pump in said hot-water return line and reducing delivery of a feed water pump connected to said cold water reservoir; and reducing delivery substantially at full peak load.

22. The method as defined in claim 21 including the step of regulating the opening of said flash steam valve dependent on the required output so that the opening of said flash steam valve is enlarged for increasing the output.

23. The method as defined in claim 21 including the step of regulating delivery of said storage water pump depending on the amount of water flowing through a hot water line and depending on the water level in said secondary steam generator so that delivery is increased with increase in the amount of water flowing and raising of said water level.

24. The method as defined in claim 21 including the step of arranging said secondary steam generator as a multi-stage steam generator with flash tanks and flash steam valves; reducing the opening of one of said flash steam valves of higher pressure in relation to one of said flash steam valves of lower pressure to increase the output of the turbine during continuous energy generation, said opening of said flash steam valve of higher pressure being increased in relation to said flash steam valve of lower pressure when reducing the output of the turbine.

25. The method as defined in claim 24 including the steps of: connecting the first flash tank of said multi-stage flash steam generator to said hot water line; connecting the second flash tank to said hot water line by a hot-water bypass; arranging a hot-water bypass valve within said hot water bypass; opening said hot-water bypass valve together with the step of opening said flash steam valves for continuous energy generation said hot-water bypass valve being closed during progressive discharge of said storage vessel.

26. The method as defined in claim 25 including upon steam failure the steps of opening said turbine valve and said steam valve; closing a water valve within a hot-water charge line connecting said feed water line to said steam cushion volume of said storage vessel, and said flash steam valves as well as said hot-water bypass valve; opening substantially immediately after failure of the steam generator said flash steam valve; and at least reducing the opening of said turbine valve for generating a substantially small passage of cool steam after achieving steam delivery from flash tanks.

27. The method as defined in claim 21 including the step of at least opening said turbine valve during discharge of said storage vessel for a substantially brief increase in output upon steam failure.

28. The method as defined in claim 21 including the step of charging the storage vessel when operating the main steam cycle by increasing the delivery of said feed water pump, opening a water valve within a hot-water charge line connecting said feed water line to said steam cushion volume of said storage vessel and opening said steam valve.

29. The method as defined in claim 21 including the step of charging the storage vessel for continuous energy generation by opening said steam valve for pressure condensation and then opening a water valve within a hot-water charge line connecting said feed water line to said steam cushion volume of said storage vessel, regulating said steam valve depending on available excess output, and regulating said water valve depending on the amount of steam flowing through said auxiliary steam line.

* * * * *